US009500997B2

(12) United States Patent
Sakamoto et al.

(10) Patent No.: US 9,500,997 B2
(45) Date of Patent: Nov. 22, 2016

(54) DEVELOPMENT ROTATING MEMBER FOR LIQUID DEVELOPMENT, LIQUID DEVELOPING DEVICE, IMAGE FORMING APPARATUS, AND PROCESS CARTRIDGE

(71) Applicant: FUJI XEROX CO., LTD., Tokyo (JP)

(72) Inventors: Tokuya Sakamoto, Kanagawa (JP); Tatsuo Okuno, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/822,056

(22) Filed: Aug. 10, 2015

(65) Prior Publication Data

US 2016/0282766 A1 Sep. 29, 2016

(30) Foreign Application Priority Data

Mar. 24, 2015 (JP) ..... 2015-061677

(51) Int. Cl.
*G03G 15/10* (2006.01)
*G03G 15/16* (2006.01)

(52) U.S. Cl.
CPC ..... *G03G 15/104* (2013.01); *G03G 15/1685* (2013.01)

(58) Field of Classification Search
CPC ..... G03G 15/1685; G03G 15/104; G03G 15/0921
USPC ..... 399/239
See application file for complete search history.

(56) References Cited

U.S. PATENT DOCUMENTS 5,255,059 A * 10/1993 Kai ..... G03G 15/0921 399/265
6,167,225 A * 12/2000 Sasaki ..... G03G 15/101 399/237
2002/0098016 A1 7/2002 Kurotori et al.
2004/0105702 A1 6/2004 Kurotori et al.
2005/0041997 A1 2/2005 Kurotori et al.
2007/0223971 A1* 9/2007 Takagi ..... G03G 15/0886 399/258
2008/0232862 A1* 9/2008 Fujishima ..... G03G 15/0818 399/285
2009/0060587 A1* 3/2009 Tanjo ..... G03G 15/104 399/249

FOREIGN PATENT DOCUMENTS

JP 2002-287518 A 10/2002
JP 2006-071882 A 3/2006
JP 2006-163429 A 6/2006

* cited by examiner

*Primary Examiner* — David Gray
*Assistant Examiner* — Trevor J Bervik
(74) *Attorney, Agent, or Firm* — Oliff PLC

(57) ABSTRACT

A development rotating member for liquid development includes a base material, an elastic layer that is provided on the base material, and a surface layer that is provided on the elastic layer and contains a polyimide resin, wherein a JIS-A hardness of the development rotating member is in a range of 40 degrees to 80 degrees.

10 Claims, 3 Drawing Sheets

DEVELOPMENT ROTATING MEMBER FOR LIQUID DEVELOPMENT, LIQUID DEVELOPING DEVICE, IMAGE FORMING APPARATUS, AND PROCESS CARTRIDGE

CROSS-REFERENCE TO RELATED APPLICATIONS

This application is based on and claims priority under 35 USC 119 from Japanese Patent Application No. 2015-061677 filed Mar. 24, 2015.

BACKGROUND

1. Technical Field

The present invention relates to a development rotating member for liquid development, a liquid developing device, an image forming apparatus, and a process cartridge.

2. Related Art

In the related art, an image forming apparatus and an image forming method with an electrophotographic system which uses a liquid developer in which a toner is dispersed in a carrier liquid as a developer are known.

SUMMARY

According to an aspect of the invention, there is provided a developing rotary member for liquid development, including:

a base material;

an elastic layer that is provided on the base material; and a surface layer that is provided on the elastic layer and contains a polyimide resin;

wherein a JIS-A hardness of the developing rotary member is in a range of 40 degrees to 0.0 degrees.

BRIEF DESCRIPTION OF THE DRAWINGS

Exemplary embodiments of the present invention will be described in detail based on the following figures, wherein:

FIG. 3A is a schematic view illustrating a state in which a liquid developer is held in concave portions of a supply rotary member; FIG. 3B is a schematic view illustrating a state in which a surface layer of the supply rotary member is not in contact with the liquid developer held in the concave portions of the supply rotary member; and FIG. 3C is a schematic view illustrating a state in which the surface layer of the supply rotary member is in contact with the liquid developer held in the concave portions of the supply rotary member.

DETAILED DESCRIPTION

Hereinafter, an exemplary embodiment which is an example of the invention will be described.

Development Rotating Member for Liquid Development

Figure 2:
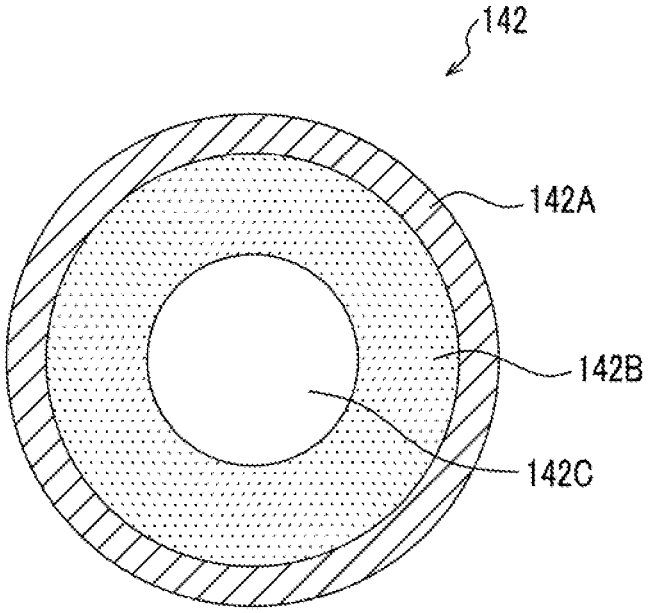
FIG. 2 is a sectional view schematically illustrating an example of the development rotating member for liquid development according to the exemplary embodiment.

A development rotating member for liquid development (hereinafter, also referred to as a "developing roll") according to the exemplary embodiment of the invention includes a base material; an elastic layer provided on the base material; and a surface layer that is provided on the elastic layer and contains a polyimide resin (see FIG. 2). Further, the JIS-A hardness of the developing roll (development rotating member) is in the range of 40 degrees to 80 degrees. In addition, in FIG. 2, the reference numeral 142 indicates the development rotating member for liquid development (developing roll), the reference numeral 142A indicates the surface layer; the reference numeral 142B indicates the elastic layer; and the reference numeral 142C indicates the base material.

The developing roll may include a known functional layer in addition to the elastic layer and the surface layer. Specifically, the developing roll may include an adhesive layer that adheres the elastic layer to the base material and a resistance adjusting layer between the elastic layer and the surface layer.

The developing roll (development rotating member) has conductivity. In the present specification, this means that the volume resistivity at 20° C. is less than $1\times10^{13}$ Ωcm. Further, the development rotating member is not limited to the aspect of the developing roll and may have an aspect of a developing belt.

The developing roll according to the exemplary embodiment of the invention realizes formation of a nearly uniform liquid developer layer with the above-described configuration and has excellent cleaning properties. The reason therefor is assumed as follows.

First, as a developing device having a liquid developing system, for example, a device which includes an accommodating portion that accommodates a liquid developer; a developing roll that holds the liquid developer on the surface thereof; a blade that is brought into contact with the surface of the liquid developing roll and performs cleaning; and a supply rotary member (hereinafter, also referred to as an "anilox roll") that is brought into contact with the developing roll, provided in a state in which a part thereof is immersed in the liquid developer accommodated in the accommodating portion, and supplies the liquid developer to the surface of the developing roll while rotating is known (see FIG. 1). That is, in the developing device having such a liquid developing system, the developing roll is in contact with the blade, and the anilox roll and the liquid developer is supplied from the anilox roll while the developing roll is rotating, and the liquid developer is held on the surface thereof in a layer form.

The anilox roll includes concave portions (grooves) on the surface in order to supply a liquid developer to the developing roll. The anilox roll holds a certain amount of liquid developer in the concave portions by the surplus liquid developer being scraped by a supply amount regulating member which is referred to as a metering blade after pumping out the liquid developer while rotating.

The liquid developer held in the concave portions of the anilox roll is supplied to the surface of a developing roll by an electric field and wettability. The liquid developer held by the developing roll is transitioned to an image holding member or transitioned to an image holding member through another developing roll, develops an electrostatic latent image, and forms a toner image. Next, the liquid developer remaining on the developing roll is scraped off by the blade.

In the developing device having such a liquid developing system, since the anilox roll is in contact with the developing roll and the liquid developer is supplied to the developing roll from the anilox roll, the friction load with the anilox roll having the concave portions on the surface is applied to the surface of the developing roll. Therefore, the surface of the developing roll has needs to have high mechanical strength and thus excellent abrasion resistance properties.

In addition, there is a technique of using a polyimide resin for a surface layer of a developing roll for the purpose of imparting excellent abrasion resistance properties.

However, the JIS-A hardness of the developing roll in the related art which includes a surface layer containing a polyimide resin exceeds 80 degrees, which is excessively high, derived from the characteristics of the polyimide resin. When the hardness of the developing roll becomes excessively high, the uniformity of a liquid developing layer to be formed on the developing roll is deteriorated.

The anilox roll has concave portions each of which has a width of several tens of micrometers to several hundreds of micrometers and a depth of several tens of micrometers and holds the liquid developer in the concave portions. At this time, the height of the liquid surface of the liquid developer is lower than a wall surface of the roll surface by several micrometers (see FIG. 3A).

Figure 3A:
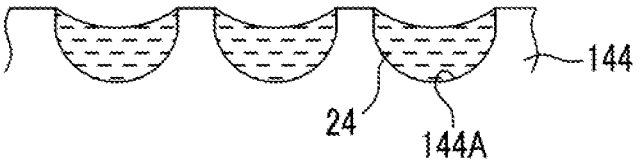
FIGS. 3A to 3C are schematic views for describing an action of the development rotating member for liquid development according to the exemplary embodiment.
Figure 3B:
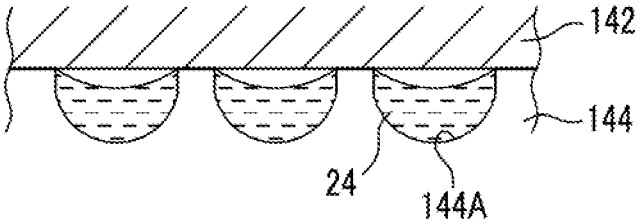

Accordingly, when the JIS-A hardness of the developing roll exceeds 80 degrees, the followability of the developing roll with respect to the anilox roll is deteriorated and the developing roll (the surface layer thereof) is unlikely to penetrate into the concave portions of the anilox roll (see FIG. 3B). As a result, a portion in which the liquid developer is not supplied to the surface of the developing roll (that is, a portion in which the liquid developer is not transferred to the developing roll from the anilox roll) is caused and the uniformity of the liquid developing layer to be formed on the developing roll is deteriorated.

Meanwhile, when the JIS-A hardness of the developing roll is 80 degrees or less, the followability of the developing roll with respect to the anilox roll is enhanced, the developing roll (the surface layer thereof) easily penetrates into the concave portions of the anilox roll (see FIG. 3C), the generation of a portion in which the liquid developer is not supplied to the surface of the developing roll (that is, a portion in which the liquid developer is not transferred to the developing roll from the anilox roll) is prevented, and the uniformity of the liquid developing layer to be formed on the developing roll is enhanced.

Figure 3C:
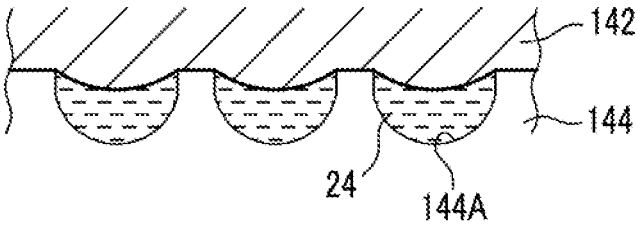

Further, in FIGS. 3A, 3B, and 3C, the reference numeral 144 indicates the anilox roll. The reference numeral 144A indicates the concave portion of the anilox roll. The reference numeral. 142 indicates the developing roll. The reference numeral 24 indicates the liquid developer.

When the uniformity of the liquid developing layer to be formed on the developing roll is intended to be enhanced by excessively lowering the JIS-A hardness of the developing roll to be less than 40 degrees and increasing the followability of the developing roll with respect to the anilox roll, the contact area between the developing roll and the blade is increased and the friction force is increased. Consequently, a part of the blade is curled, slipping of the liquid developer is easily caused, and thus the cleaning properties of the developing roll are deteriorated.

Meanwhile, when the JIS-A hardness of the developing roll is set to be 40 degrees or greater, an excessive increase in the contact area between the developing roll and the blade is prevented and an increase in the friction force is prevented. Consequently, the curling of the blade is prevented, the slipping of the liquid developer is prevented, and the deterioration of the cleaning properties of the developing roll is prevented.

As described above, it is assumed that the developing roll (development rotating member) according to the exemplary embodiment of the invention includes a surface layer which contains a polyimide resin and has high abrasion resistance properties, realizes formation of a nearly uniform liquid developer layer, and has excellent cleaning properties.

In addition, when the developing roll according to the exemplary embodiment of the invention is used, formation of image deletion and deterioration of graininess of an image are prevented. Further, formation of an image defect caused by cleaning failure of the developing roll is prevented. In addition, since the developing roll includes the surface layer which contains a polyimide resin and has excellent abrasion resistance properties, the life of the developing roll is prolonged.

Here, in the developing roll according to the exemplary embodiment, the JIS-A hardness of the developing roll is in the range of 40 degrees to 80 degrees. In terms of the uniformity and the cleaning properties of the liquid developer layer, the JIS-A hardness thereof is preferably in the range of 45 degrees to 75 degrees and more preferably in the range of 50 degrees to 70 degrees.

The JIS-A hardness of the developing roll is a value measured in conformity with JIS K6253 "Rubber, vulcanized or thermoplastic determination of hardness" using a Durometer type A (manufactured by TECHLOCK Corporation). Specifically, an indenter is promptly pressed to the surface of the developing roll (surface of the surface layer) while avoiding an impact and the maximum value of an indicator needle is read within 1 second. In addition, this process of measurement is repeatedly performed five times and the average value thereof is acquired as the JIS-A hardness of the developing roll.

In order to adjust the JIS-A hardness of the developing roll to be in the above-described range, for example, a method of adjusting the thickness of the surface layer and the JIS-A hardness of the elastic layer may preferably be used. Specifically, for example, the thickness of the surface layer may preferably be adjusted to be in the range of 10 μm to 40 μm. Moreover, the JIS-A hardness of the elastic layer may be adjusted to be in the range of 30 degrees to 70 degrees.

Hereinafter, the developing roll according to the exemplary embodiment of the invention will be described in detail.

The base material will be described.

The base material has conductivity. Examples of the base material include cored bar made of metals or alloys which are formed of metals or alloys such as iron (free-cutting steel or the like), copper, brass, stainless steel, aluminum, and nickel; and iron to which a plating treatment is applied using chromium or nickel. Examples of the base material include a core metal to which a plating treatment is applied to the outer peripheral surface (for example, a resin core metal or a ceramic core metal) and a core metal in which a conducting material is dispersed (for example, a resin core metal or a ceramic core metal). The core metal may be a hollow member (cylindrical member) or a non-hollow member.

Further, in a case where the development rotating member is a developing belt, a belt made of a metal or an alloy is exemplified as the base material.

The elastic layer will be described.

The elastic layer has conductivity. The elastic layer contains, for example, an elastic material and a conducting material. The elastic layer may be a foam elastic layer or a non-foam elastic layer, but a foam elastic layer is preferable in terms of the uniformity and the cleaning properties of the liquid developer layer.

Examples of an elastic material include rubber materials such as silicone rubber, fluorine rubber, urethane rubber, ethylene-propylene-dien copolymer rubber (EPDM), acrylonitrile-butadiene copolymer rubber (NBR), chloroprene rubber (CR), chlorinated polyisoprene, isoprene, styrene-butadiene rubber, hydrogenated polybutadiene, and butyl rubber. Further, examples of the elastic material also include resin materials such as a polyethylene resin, a polyamide resin, and a polypropylene resin.

The elastic materials may be used alone or in combination of two or more kinds thereof.

Among these, in terms of the uniformity and the cleaning properties of the liquid developer layer, it is preferable that urethane rubber is used for the elastic material when the JIS-A hardness of the developing roll.

As the conducting material, an electronic conducting material or an ion conducting material is used.

Examples of the electron conducting material include powder of carbon black such as ketjenblack or acetylene black; pyrolytic carbon, graphite; various conductive metals or alloys such as aluminum, copper, nickel, and stainless steel; various conductive metal oxides such as tin oxide, indium oxide, titanium oxide, a tin oxide-antimony oxide solid solution, a tin oxide-indium oxide solid solution; and a substance obtained by applying a conduction treatment to the surface of an insulating material.

Examples of the ion conducting material include perchlorate or chlorate of oniums such as tetraethyl ammonium or lauryl trimethyl ammonium; and perchlorate or chlorate of an alkali metal such as lithium and magnesium and alkaline earth metal.

These conducting materials may be used along or in combination of two or more kinds thereof.

The content of the conducting material is not particularly limited. However, in a case of the electronic conducting material, it is preferable that the content of the conducting material is in the range of 1 part by weight to 60 parts by weight based on 100 parts by weight of the elastic material. Meanwhile, in a case of the ion conducting material, it is preferable that the content of the conducting material is in the range of 0.1 parts by weight to 5.0 parts by weight based on 100 parts by weight of the elastic material.

Moreover, the elastic layer may contain known additives, for example, auxiliaries such as a foaming auxiliary, a foam stabilizer, a catalyst, a curing agent, a plasticizer, and a vulcanization accelerator.

In terms of the uniformity and the cleaning properties of the liquid developer layer, the JIS-A hardness of the elastic layer is preferably in the range of 30 degrees to 70 degrees, more preferably in the range of 35 degrees to 65 degrees, and still more preferably in the range of 40 degrees to 60 degrees.

The JIS-A hardness of the elastic layer is a value measured in conformity with JIS K6253 "Rubber, vulcanized or thermoplastic determination of hardness" using a Durometer type A (manufactured by TECHLOCK Corporation). Specifically, an indenter is promptly pressed to the surface of the elastic layer obtained by removing the surface layer from the developing roll while avoiding an impact and the maximum value of an indicator needle is read within 1 second. In addition, this process of measurement is repeatedly performed for five times and the average value thereof is acquired as the JIS-A hardness of the developing roll.

In terms of the uniformity and the cleaning properties of the liquid developer layer, the thickness of the elastic layer is preferably in the range of 5 mm to 25 mm, more preferably in the range of 7 mm to 20 mm, and still more preferably in the range of 10 mm to 15 mm.

The thickness of the elastic layer is a value measured using the following method. Three places in a position from both ends of the elastic layer (charging member) in the axial direction by 20 mm and in the central portion are cut out using a single-edged knife, the sections of the cut-out samples are observed at an appropriate magnification from 5 times to 50 times in accordance with the thickness, and the film thickness is measured to acquire the average value thereof. A digital microscope VHX-200 (manufactured by KEYENCE CORPORATION) is used as the measuring device.

A method of forming an elastic layer is not particularly limited. For example, a method of performing extrusion molding by kneading all components constituting an elastic layer in advance using a tumbler or a V blender and melting and kneading the components using an extruder is exemplified.

The surface layer will be described.

The surface layer contains a polyimide resin. As the polyimide resin, an imidized product of a polyamic acid (polyimide precursor) which is a polymer of a tetracarboxylic dianhydride and a diamine compound is exemplified. Specifically, the polyimide resin is obtained by performing a polymerization reaction on an equimolecular amount of the tetracarboxylic dianhydride and the diamine compound in a solvent to obtain the resultant as a solution of polyamide acid and by imidizing the polyamide acid.

Examples of the tetracarboxylic dianhydride include a pyromellitic dianhydride, a 3,3',4,4'-benzophenone tetracarboxylic dianhydride, a 3,3',4,4'-biphenyl tetracarboxylic dianhydride, a 2,3,3',4-biphenyl tetracarboxylic dianhydride, a 2,3,6,7-naphthalene tetracarboxylic dianhydride, a 1,2,5,6-naphthalene tetracarboxylic dianhydride, a 1,4,5,8-naphthalene tetracarboxylic dianhydride, a 2,2'-bis(3,4-dicarboxyphenyl)sulfonic dianhydride, a perylene-3,4,9,10-tetracarboxylic dianhydride, a bis(3,4-dicarboxyphenyl) ether dianhydride, and an ethylene tetracarboxylic dianhydride.

Meanwhile, examples of the diamine compound include 4,4'-diamino diphenyl ether, 4,4'-diamino diphenyl methane, 3,3'-diamino diphenyl methane, 3,3'-dichloro benzidine, 4,4'-diamino diphenyl sulfide, 3,3'-diamino diphenyl sulfone, 1,5-diamino naphthalene, m-phenylene diamine, p-phenylene diamine, 3,3'-dimethyl-4,4'-biphenyl diamine, benzidine, 3,3'-dimethyl benzidine, 3,3'-dimethoxy benzidine, 4,4'-diamino diphenyl sulfone, 4,4'-diamino diphenyl propane, 2,4-bis(β-tertbutylamino) toluene, bis(p-β-amino-tertbutylphenyl)ether, bis(p-β-methyl-δ-aminophenyl)benzene, bis-p-(1,1-dimethyl-5-amino-pentyl)benzene, 1-isopropyl-2,4-m-phenylene diamine, m-xylylene diamine, p-xylylene diamine, di(p-aminocyclohexyl)methane, hexamethylene diamine, heptamethylene diamine, octamethylene diamine, nonamethylene diamine, decamethylene diamine, diamino propyl tetramethylene, 3-methyl heptamethylene diamine, 4,4-dimethyl heptamethylene diamine, 2,11-diaminododecane, 1,2-bis-3-aminopropoxy ethane, 2,2-dimethyl propylene diamine, 3-methoxy hexamethylene diamine, 2,5-dimethyl heptamethylene diamine, 3-methyl heptamethylene diamine, 5-methyl nonamethylene diamine, 2,17-diamino eicosadecane, 1,4-diamino cyclohexane, 1,10-diamino-1,10-dimethyl decane, 12-diamino octadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, and $H_2N(CH_2)_3N(CH_3)_2(CH_2)_3NH_2$.

The surface layer may contain a conducting material for the purpose of adjusting resistance of the developing roll. As the conducting material, an agent which is the same as a conducting material as that contained in the elastic layer is exemplified.

In terms of the uniformity and the cleaning properties of the liquid developer layer, the thickness of the surface layer is preferably in the range of 10 μm to 40 μm, more preferably in the range of 15 μm to 35 μm, and still more preferably in the range of 20 μm to 30 μm.

The thickness of the surface layer is a value measured using the following method. Three places in a position from both ends of the elastic layer (charging member) in the axial direction by 20 mm and in the central portion are cut out using a single-edged knife, the sections of the cut-out samples are observed at an appropriate magnification from 5 times to 50 times in accordance with of the thickness, and the film thickness is measured to acquire the average value thereof. A digital microscope VHX-200 (manufactured by KEYENCE CORPORATION) is used as the measuring device.

Formation of the surface layer is not particularly limited. For example, the surface layer is formed as follows. A coating film is formed by coating a cylindrical or columnar core member with a polyamide acid solution (polyimide precursor solution) containing other additives such as a conducting material. After a drying treatment for removing a solvent is performed on the coating film in a temperature range of 50° C. to 180° C., the coating film is burned in a temperature range of higher than 180° C. to 450° C. to be imidized, and a polyimide resin tube is formed. The processes of drying and burning (imidization) are carried out in a heating furnace. Subsequently, after the polyimide resin tube is removed from the core member, the surface of the elastic roll with the elastic layer formed on the base material is covered with the polyimide resin tube. Consequently, the surface layer is formed.

Image Forming Apparatus/Developing Device

An image forming apparatus according to the exemplary embodiment includes an image holding member; a charging device that charges the surface of the image holding member; a latent image forming apparatus that forms an electrostatic latent image on the surface of the charged image holding member; a liquid developing device that develops the electrostatic latent image formed on the surface of the image holding member using a liquid developer and forms a toner image; a transfer device that transfers the toner image to a recording medium; and a fixing device that fixes the toner image on the recording medium to the recording medium.

The liquid developing device includes an accommodating portion that accommodates a liquid developer; a development rotating member for liquid development that holds the liquid developer on the surface thereof; a blade that is brought into contact with the surface of a liquid-development rotating member and performs cleaning; and a supply rotary member that is brought into contact with the development rotating member for liquid development, provided in a state in which a part thereof is immersed in the liquid developer accommodated in the accommodating portion, and supplies the liquid developer to the surface of the development rotating member for liquid development while rotating. In addition, the development rotating member for liquid development according to the exemplary embodiment of the invention is employed as the development rotating member for the liquid development. Moreover, in a case where a plurality of liquid-development rotating members are included, the development rotating member for liquid development according to the exemplary embodiment of the invention is employed as the liquid-development rotating member that is brought into contact with at least the supply rotary member.

As the image forming apparatus according to the exemplary embodiment of the invention, a known image forming apparatus such as a device with a direct transfer system which directly transfers a toner image formed on the surface of an image holding member to a recording medium; a device with an intermediate transfer system which primarily transfers a toner image formed on the surface of an image holding member to the surface of an intermediate transfer member and secondarily transfers the toner image transferred to the surface of the intermediate transfer member to the surface of a recording medium; a device which includes a cleaning unit cleaning the surface of an image holding member after a toner image is transferred and before the image holding member is charged; a device which includes an erasing unit irradiating the surface of an image holding member with erasing light and erasing the surface thereof after a toner image is transferred and before the image holding member is charged; or a device which includes a heating member heating an image holding member for increasing the temperature of an electrophotographic photoreceptor and decreasing the relative temperature is employed.

In a case of the device with the intermediate transfer system, a configuration in which a transfer unit includes an intermediate transfer member to the surface of which a toner image is transferred; a primary transfer unit that primarily transfers the toner image formed on the surface of the image holding member to the surface of the intermediate transfer member; and a secondary transfer unit that secondarily transfers the toner image transferred to the surface of the intermediate transfer member to the surface of a recording medium is employed.

In the image forming apparatus according to the exemplary embodiment of the invention, for example, a portion including the image holding member and the liquid developing device may have a cartridge structure (process cartridge) which is detached from the image forming apparatus. As the process cartridge, for example, a process cartridge including the image holding member and the liquid developing device is preferably used. Moreover, the process cartridge may include at least one selected from a group consisting of the charging device, the latent image forming apparatus, and the transfer device in addition to the electrophotographic photoreceptor.

Hereinafter, an example of the image forming apparatus according to the exemplary embodiment of the invention will be described, but the image forming apparatus is not limited thereto. In addition, main portions illustrated in the figure are described and the description of the rest will be omitted.

Figure 1:
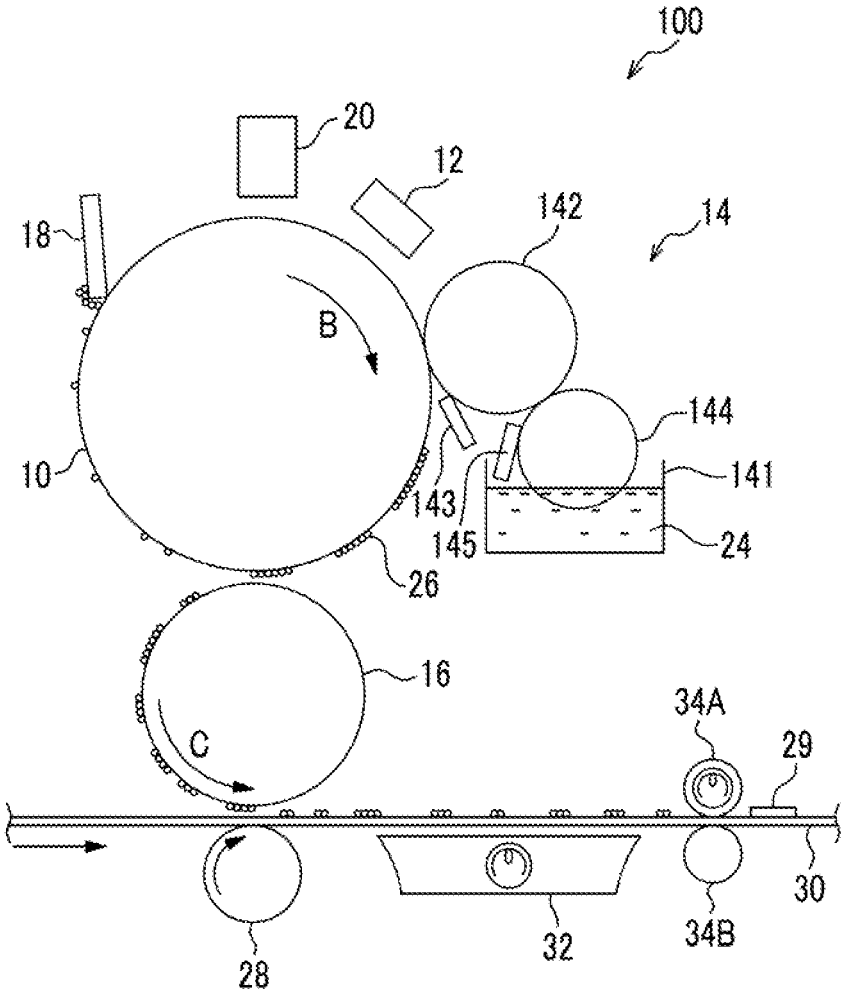
FIG. 1 is a configuration view schematically illustrating an example of an image forming apparatus according to an exemplary embodiment.

FIG. 1 is a configuration view schematically illustrating an example of the image forming apparatus according to an exemplary embodiment of the invention.

An image forming apparatus 100 includes a photoreceptor 10 (an example of the image holding member). In addition, a charging device 20, an exposure device 12, a liquid developing device 14, an intermediate transfer member 16, and a cleaning blade 18 are sequentially provided around the photoreceptor 10.

The image forming apparatus 100 includes the intermediate transfer member 16 to which a toner image 26 formed on the photoreceptor 10 is transferred; a transfer roll 28 that transfers the toner image 26 transferred to the intermediate transfer member 16 to paper (recording medium 30); a non-contact heating device (first heating device) 32 that is provided on the downstream side than the transfer roll 28 in the traveling direction of the paper 30; and heating and pressurizing rolls (second heating and pressuring devices) 34A and 34B that are provided on the downstream side of the non-contact heating device 32 in the traveling direction of the paper 30.

Moreover, in the exemplary embodiment of the invention, the transfer device is configured of the intermediate transfer member 16 and the transfer roll 28. Further, the fixing device is configured of the non-contact heating device (first heating device) 32 and the heating and pressurizing rolls (second heating and pressurizing devices) 34A and 34B.

Here, the liquid developing device 16 is a liquid developing device with a contact developing system. Specifically, the liquid developing device 16 includes a developer tank 141 (an example of the accommodating portion); a developing roll 142 (an example of the development rotating member) that holds a liquid developer; a blade 143 that is brought into contact with the surface of the developing roll 142 and performs cleaning; and an anilox roll 144 (an example of the supply rotary member) that is brought into contact with the developing roll 142 and provided in a state in which a part thereof is immersed in the liquid developer accommodated in the developer tank 141. A metering blade 145 (an example of the supply amount regulating member) that regulates the amount of the liquid developer to be supplied to the developing roll 142 is provided in the vicinity of the anilox roll 144.

The developing roll 142 is provided in a state of being in contact with the photoreceptor 10 and the anilox roll 144 and being rotatable with a direction of rotation axis aligned.

In the liquid developing device 16, after the anilox roll 144 including concave portions pumps out the liquid developer, the surplus liquid developer is regulated by the metering blade 145 while the developing roll 142, the anilox roll 144, and the photoreceptor 10 are rotating at a constant velocity. Further, development is carried out by supplying the liquid developer from the anilox roll 144 to the developing roll 142 and transitioning the liquid developer supplied to the developing roll 142 to the photoreceptor 10. The developing roll 142 is cleaned by the blade 143 after the liquid developer is transitioned to the photoreceptor 10.

Further, the number of developing roll 142 is not limited to one and two or more developing rolls 142 may be provided. In a case where two or more developing rolls 142 are provided, development is carried out by repeatedly transitioning the liquid developer from the developing roll in contact with the anilox roll 144 to the developing roll in contact with the photoreceptor 10.

Hereinafter, an operation of the image forming apparatus 100 will be simply described.

The charging device 20 charges the surface of the photoreceptor 10 to a predetermined potential, the exposure device 12 exposes the charged surface to, for example, a laser beam based on an image signal, and thereby an electrostatic latent image is formed.

Next, the liquid developer 24 supplied to the developing roll 142 of the liquid developing device is transported to the photoreceptor 10 and supplied to the electrostatic latent image in a position in which the developing roll 142 is in contact with the photoreceptor 10. Consequently, the electrostatic latent image is visualized and turned into the toner image 26.

The developed toner image 26 is transported to the photoreceptor 10 that rotates in a direction of an arrow B in the figure and transferred to the intermediate transfer member 16. At this time, a peripheral speed difference may be present between the photoreceptor 10 and the intermediate transfer member 16.

Next, the toner image transported in a direction of an arrow C by the intermediate transfer member 16 is transferred to the paper 30 in a position in contact with the transfer roll 28.

Next, the toner image is heated by the non-contact heating device (first heating device) 32 provided on the downstream side of the transfer roll 28 in the traveling direction of the paper 30. In addition, the toner image is heated and pressurized by the heating and pressurizing roll (second heating and pressuring devices) 34A and 34B provided on the downstream side of the non-contact heating device (first heating device) 32 in the traveling direction of the paper 30. After this process, the toner image is fixed to the paper 30.

Here, the non-contact heating device 32 is a plate-shaped heating device and a heater is provided inside of a plate-shaped member whose surface is formed of a metal. As the heater, a halogen heater or a hot air dryer is used in a case where a toner image is heated in a non-contact manner from the toner image side which is a target for heating, and a heating plate or a heating roll in contact with the rear surface of the toner image is used in a case where the toner image is heated from the rear surface (that is, the recording medium side) of the toner image which is a target for heating.

Further, the heating and pressurizing rolls 34A and 34B form nip portions by nipping the paper 30 therebetween and are arranged so as to face each other. The heating and pressurizing rolls 34A and 34B include an elastic rubber layer on a metal roll and a releasing layer for releasing a toner and nip the paper 30 using a pressurizing mechanism (not illustrated) at a determined pressure and a nip width. In addition, at least one of the heating and pressurizing rolls 34A and 34B includes a heater, but both of the heating and pressurizing rolls 34A and 34B may include the heater.

Next, a fixed image 29 is formed by a toner image being fixed to the paper 30 in a position of the heating and pressurizing rolls 34A and 34B and then the paper 30 is fed to an ejection unit (not illustrated).

Meanwhile, in the photoreceptor 10 that transfers the toner image 26 to the intermediate transfer member 16, transfer residual toner particles are transported to a position in contact with the cleaning blade 18 and collected by the cleaning blade 18. In addition, in a case where transfer efficiency is nearly 100% and formation of residual toner is reduced, the cleaning blade 18 may not be provided.

The image forming apparatus 100 may further include an erasing device (not illustrated) that erases the surface of the photoreceptor 10 after the toner image is transferred and before the surface of the photoreceptor 10 is subsequently charged.

All of the charging device 20, the exposure device 12, the liquid developing device 14, the intermediate transfer member 16, the transfer roll 28, the cleaning blade 18, and the non-contact heating device (first heating device) 32, the heating and pressurizing rolls (second heating and pressurizing devices) 34A and 34B which are provided in the image forming apparatus 100 are operated in synchronization with the rotation velocity of the photoreceptor 10.

The image forming apparatus 100 may have a system of supplying the liquid developer to the developer tank 141 from a liquid developer cartridge (not illustrated) which is detached from the image forming apparatus.

Further, the photoreceptor 10 and the liquid developing device 14 may have the system of the process cartridge which is detached from the image forming apparatus 100.

EXAMPLES

Hereinafter, the invention will be further described in detail with reference to Examples, but Examples described below are not intended to limit the invention. Moreover, "parts" and "%" below are on a weight basis unless otherwise noted.

Example 1

First, in a state in which a core metal made of stainless steel which has an outer diameter of 150 mm is disposed in the central portion in a mold having a target shape, a raw material is mixed and stirred and then injected to the mold and cured, to thereby form a urethane foam rubber layer (elastic layer), whereby a foam rubber roll is prepared. Next, a tubular mold is coated with a polyamide acid solution, the polyamide acid is imidized by being heated, and then the resultant is released from the mold, thereby preparing a polyimide tube. In addition, a polyurethane foam rubber layer of the foam rubber roll is covered with the polyimide tube.

Through the process described above, a developing roll having characteristics shown in Table 1 is prepared. The volume resistivity of the developing roll is $1\times10^6$ (Ωcm).

Examples 2 to 5 and Comparative Examples 1 to 4

Developing rolls having the characteristics shown in Table 1 are prepared according to the preparation of the developing roll of Example 1.

Evaluation

The developing rolls prepared in the respective examples each is mounted on a liquid developing device of an image forming apparatus having a liquid developing system. In addition, the following evaluations are performed using the image forming apparatus having the liquid developing system. Further, a roll manufactured by HarperCollins is used as the anilox roll of the liquid developing device.

Film-Forming Properties of Liquid Developer on Developing Roll

The film-forming properties of the liquid developer on the developing roll are evaluated as described below.

An image is formed by operating the image forming apparatus having the liquid developing system. Next, the developing roll is taken out from the device, the liquid developer layer on the developing roll is visually inspected, occurrence of slipping of the liquid developer (deletion of a toner) is observed to thereby evaluate the film-forming properties of the liquid developer on the developing roll. The evaluation criteria are as follows.

A: Slipping of the liquid developer (deletion of a toner) does not occur.

B): Slipping of the liquid developer (deletion of a toner) occurs occasionally.

C: Slipping of the liquid developer (deletion of a toner) occurs.

Cleaning Properties of Developing Roll

The cleaning properties of the developing roll are evaluated as described below.

The liquid developer is supplied onto the developing roll by bringing the anilox roll into contact with the developing roll. Respective rolls are rotary driven for 1 minute, passing of the liquid developer (passing of a toner) from the cleaning blade after the rolls are stopped is observed to thereby evaluate the cleaning properties of the developing roll. The evaluation criteria are as follows.

A: Passing of the liquid developer (passing of a toner) does not occur.

B: Passing of the liquid developer (passing of a toner) occurs occasionally.

C: Passing of the liquid developer (passing of a toner) occurs.

Tears of Surface Layer of Developing Roll

Tears of the surface layer of the developing roll are evaluated as described below.

The anilox roll is brought into contact with the developing roll, respective rolls are rotary driven for 1 minute, the surface layer is observed using a digital microscope VHX-200 (manufactured by KEYENCE CORPORATION) after the rolls are stopped to evaluate the tears of the surface layer of the developing roll. The evaluation criteria are as follows.

A: Tears are not formed in the surface layer.

B: Tears are slightly formed in the surface layer.

C: Tears are formed in the surface layer.

TABLE 1

| | Comparative Example 1 | Example 1 | Example 2 | Example 3 | Example 4 | Example 5 | Comparative Example 2 | Comparative Example 3 | Comparative Example 4 |
|---|---|---|---|---|---|---|---|---|---|
| JIS-A hardness (degree) of developing roll | 30 | 40 | 40 | 60 | 80 | 80 | 90 | 90 | 90 |
| Thickness (μm) of surface layer | 10 | 8 | 10 | 20 | 10 | 40 | 50 | 50 | 10 |
| JIS-A hardness (degree) of elastic layer | 20 | 35 | 30 | 40 | 70 | 50 | 30 | 50 | 80 |
| Film-forming properties of liquid developer on developing roll | A | A | A | A | A | A | C | C | C |
| Cleaning properties of developing roll | C | A | A | A | A | A | A | A | A |
| Tears of surface layer of developing roll | A | B | A | A | A | A | A | A | A |

From the results described above, it is understood that both of the film-forming properties of the liquid developer on the developing rolls of Examples and the cleaning properties of the developing rolls of Examples are excellent compared to the cases of Comparative Examples because the JIS-A hardness of the developing rolls is in the range of 40 degrees to 80 degrees even when the polyimide resin layer is formed as the surface layer. Consequently, it is understood that the developing rolls of Examples realize formation of a nearly uniform liquid developer layer and have excellent cleaning properties.

In addition, it is understood that tears are not formed in the surface layer of the developing rolls of Examples 2 to 5 compared to the developing roll of Example 1 in which the thickness of the surface layer is less than 10 μm.

Further, it is understood that tears are easily formed in the surface layer when the thickness of the surface layer of the developing roll is less than 10 μm and the JIS-A hardness of the developing roll becomes greater than 80 degrees even in a case where the JIS-A hardness of the elastic layer is 30 degrees when the thickness of the surface layer thereof is greater than 40 μm, and thus the film-forming properties of the liquid developer on the developing roll are deteriorated. Furthermore, it is understood that the JIS-A hardness of the elastic layer becomes dominant when the thickness of the surface layer of the developing roll is less than 10 μm and the JIS-A hardness of the developing roll becomes 30 degrees when the thickness of the surface layer is 10 μm and the JIS-A hardness of the elastic layer is 20 degrees, and thus the cleaning properties are deteriorated.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developing device comprising:

an accommodating portion that accommodates a liquid developer;

a development rotating member for liquid development that holds the liquid developer on the surface thereof, the development rotating member comprising:

a base material;

an elastic layer that is provided on the base material; and a surface layer that is provided on the elastic layer and contains a polyimide resin; wherein a JIS-A hardness of the development rotating member is more than 60 degrees and 80 degrees or less, the JIS-A hardness of the development rotating member being measured on a surface of the surface layer in a state in which the surface layer is provided on the elastic layer;

a blade that is brought into contact with the surface of the development rotating member for liquid development and performs cleaning; and a supply rotary member that is brought into contact with the development rotating member for liquid development, provided in a state in which a part thereof is immersed in the liquid developer accommodated in the accommodating portion, and supplies the liquid developer to the surface of the development rotating member for liquid developer while rotating, the supply rotary member including grooves on an outer surface thereof which interact with the surface layer of the development rotating member.

2. The liquid developing device according to claim 1, wherein a thickness of the surface layer is in a range of 10 μm to 40 μm.

3. The liquid developing device according to claim 2, wherein a JIS-A hardness of the elastic layer is in a range of 30 degrees to 70 degrees.

4. The liquid developing device according to claim 3, wherein the elastic layer is a foam elastic layer.

5. The liquid developing device according to claim 2, wherein the elastic layer is a foam elastic layer.

6. The liquid developing device according to claim 1, wherein a JIS-A hardness of the elastic layer is in a range of 30 degrees to 70 degrees.

7. The liquid developing device according to claim 6, wherein the elastic layer is a foam elastic layer.

8. The liquid developing device according to claim 1, wherein the elastic layer is a foam elastic layer.

9. An image forming apparatus comprising:

an image holding member;

a charging device that charges the surface of the image holding member;

a latent image forming apparatus that forms an electrostatic latent image on the surface of the charged image holding member;

the liquid developing device according to claim 1 that develops the electrostatic latent image formed on the surface of the image holding member using a liquid developer to form a toner image;

a transfer device that transfers the toner image to a recording medium; and a fixing device that fixes the toner image on the recording medium.

10. A process cartridge that is detached from an image forming apparatus, comprising:

an image holding member; and the liquid developing device according to claim 1 that develops the electrostatic latent image formed on the surface of the image holding member using a liquid developer to form a toner image.

* * * * *